US009390723B1

(12) United States Patent
McDonough, Jr. et al.

(10) Patent No.: US 9,390,723 B1
(45) Date of Patent: Jul. 12, 2016

(54) EFFICIENT DEREVERBERATION IN NETWORKED AUDIO SYSTEMS

(71) Applicant: Amazon Technologies, Inc., Seattle, WA (US)

(72) Inventors: John Walter McDonough, Jr., Cambridge, MA (US); Wai Chung Chu, San Jose, CA (US); Amit Singh Chhetri, Santa Clara, CA (US); Robert Ayrapetian, Morgan Hill, CA (US)

( * ) Notice: Subject to any disclaimer, the term of this patent is extended or adjusted under 35 U.S.C. 154(b) by 32 days.

(21) Appl. No.: 14/568,033

(22) Filed: Dec. 11, 2014

(51) Int. Cl.
*H04R 3/00* (2006.01)
*G10L 21/02* (2013.01)
*G10K 11/175* (2006.01)

(52) U.S. Cl.
CPC ..... *G10L 21/02* (2013.01); *G10K 11/175* (2013.01)

(58) Field of Classification Search
None
See application file for complete search history.

(56) References Cited

U.S. PATENT DOCUMENTS

2009/0133566 A1* 5/2009 Nakae ..... G10H 1/0091 84/603
2009/0248403 A1* 10/2009 Kinoshita ..... H04R 3/04 704/219
2010/0208904 A1* 8/2010 Nakajima ..... H04R 1/406 381/66
2010/0211382 A1* 8/2010 Sugiyama ..... H04R 3/02 381/66
2011/0002473 A1* 1/2011 Nakatani ..... 381/66
2011/0158418 A1* 6/2011 Bai ..... H04B 3/23 381/66
2014/0270216 A1* 9/2014 Tsilfidis ..... H04R 3/002 381/66
2015/0066500 A1* 3/2015 Gomez ..... G10L 15/20 704/233

OTHER PUBLICATIONS

M. Delcroix, T. Yoshioka, A. Ogawa, Y. Kubo, M. Fujimoto, N. Ito, K. Kinoshita, M. Espi, T. Hori, T. Nakatini and A. Nakamura, "Linear prediction-based dereverberation with advanced speech enhancement and recognition technologies for the REVERB Challenge," in Proc. REVERB Challenge Workshop, Florence, Italy, Jun. 2014.

G. H. Golub and C. F. Van Loan, Matrix Computations, 3rd ed. Baltimore: The Johns Hopkins University Press, 1996.

S. Haykin, Adaptive Filter Theory, 4th ed. New York: Prentice Hall, 2002.

A. S. Householder, "Unitary triangularization of a non-symmetric matrix," pp. 339-342, (Jun. 1958).

D. Simon, Optimal State Estimation: Kalman, H ∞, and Nonlinear Aproaches. New York: Wiley, 2006.

M. Wolfel and J. McDonough, Distant Speech Recognition. London: Wiley, 2009.

T. Yoshioka and T. Nakatini, "Generalization of multi-channel linear methods for blind MIMO impulse response shortening," IEEE Trans. Audio Speech Lang. Proc., vol. 20, No. 10, 2012.

T. Yoshioka, A. Sehr, M. Delcroix, K. Kinoshita, R. Maas, T. Nakatini, and W. Kellermann, "Making machines understand us in reverberant rooms," IEEE Signal Processing Magazine, vol. 29, No. 6, 2012.

* cited by examiner

*Primary Examiner* — Thang Tran
(74) *Attorney, Agent, or Firm* — Knobbe Martens Olson & Bear LLP

(57) ABSTRACT

Features are disclosed for performing efficient dereverberation of speech signals captured with single- and multi-channel sensors in networked audio systems. Such features could be used in applications requiring automatic recognition of speech captured with sensors. Dereverberation is performed in the sub-band domain, and hence provides improved dereverberation performance in terms of signal quality, algorithmic delay, computational efficiency, and speed of convergence.

21 Claims, 5 Drawing Sheets

EFFICIENT DEREVERBERATION IN NETWORKED AUDIO SYSTEMS

BACKGROUND

Speech processing systems include various modules and components for receiving spoken input from a user and determining what the user meant. In some implementations, a speech processing system includes an automatic speech recognition ("ASR") module that receives audio input of a user utterance and generates one or more likely transcriptions of the utterance. ASR modules typically use an acoustic model and a language model. The acoustic model is used to generate hypotheses regarding which words or subword units (e.g., phonemes) correspond to an utterance based on the acoustic features of the utterance. The language model is used to determine which of the hypotheses generated using the acoustic model is the most likely transcription of the utterance based on lexical features of the language in which the utterance is spoken.

BRIEF DESCRIPTION OF THE DRAWINGS

Embodiments of various inventive features will now be described with reference to the following drawings. Throughout the drawings, reference numbers may be re-used to indicate correspondence between referenced elements. The drawings are provided to illustrate example embodiments described herein and are not intended to limit the scope of the disclosure.

DETAILED DESCRIPTION

Figure 1:
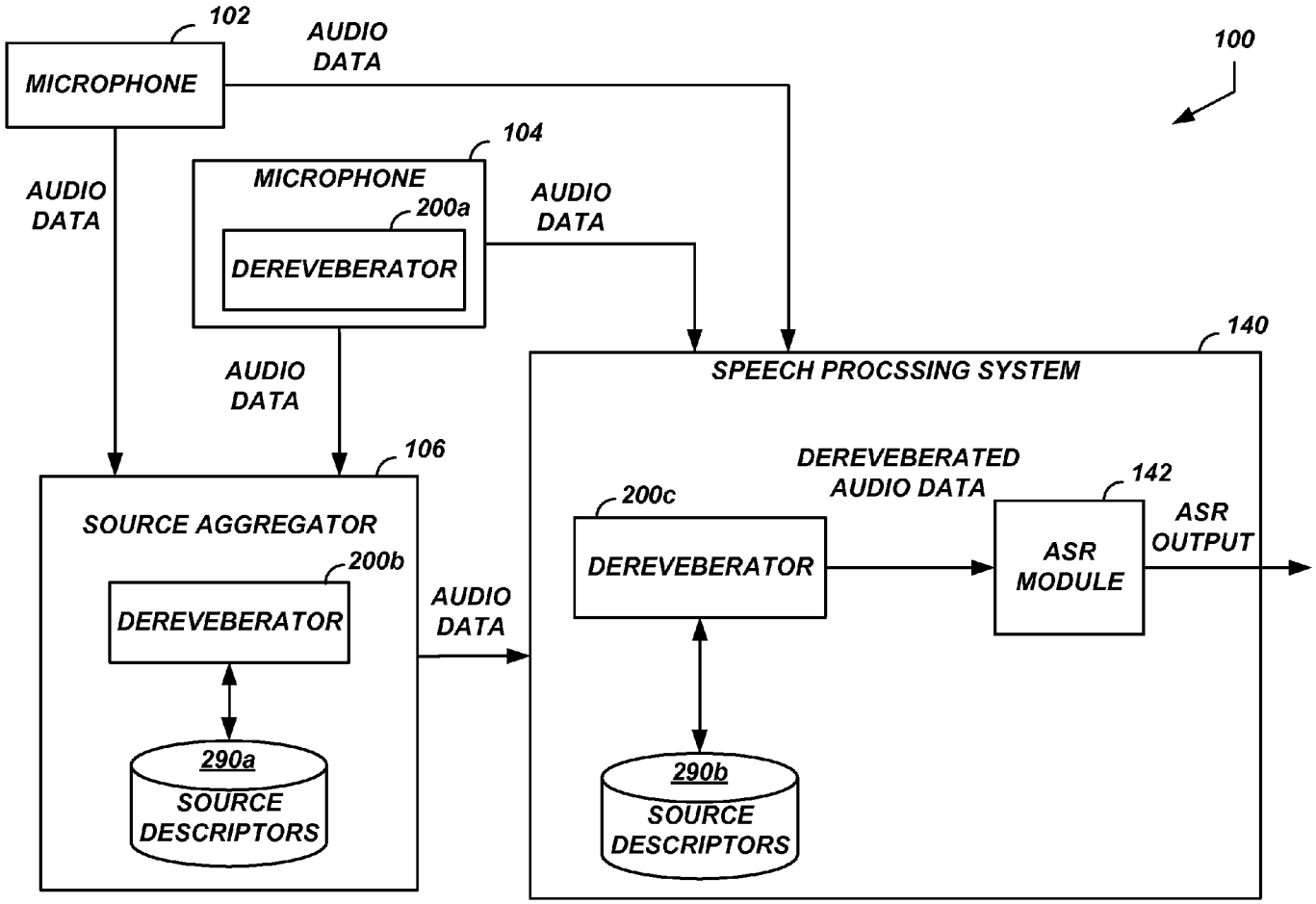
FIG. 1 shows a system diagram for an example audio processing system including reverberation removal.

Sound can be captured and digitized by audio devices. One way to capturing sound is with a microphone. Modern microphones receive the sound and convert the sound into digital audio data. Modern microphones may have some intelligence, but they cannot distinguish sound from an original source or reflected sound that is received as part of an echo or reverberation. One difference between an echo and reverberation is the time at which the reflected sound is received. Reverberation generally refers to reflected sound received within fractions of seconds, such as between 1 and 100 milliseconds, 25 and 75 milliseconds, etc., of a sound emitted from an original source. The time between the emitting of the sound and the detection of the same sound may be referred to as a reverberation time. When the reverberation time drops below a threshold value, reverberation of the emitted sound may be said to have occurred. The precise reverberation time depends upon several factors such as the acoustic environment in which the original sound is made, the device used to capture the sound, and in some cases, additional or different factors. For example, carpeting may dampen sound and thereby lower the reverberation time. Because of differences in these factors, reverberation time may be further expressed in terms of a duration of time it takes an original sound to change one or more acoustical properties (e.g., volume, amplitude, etc.) by a threshold amount. One method of determining a reverberation time involves determining the amount of time it takes for the sound to decrease by 60 decibels. In some embodiments, reverberation differs from echo in that an echo may be reflected sound received after the reverberation time.

In some cases, the reverberated sound may combine with the original emitted sound as it is captured. These sounds may be captured by the microphone and sampled as sampled audio data. Sound sampling may occur at a fixed or variable sample rate. In one embodiment, samples of the sounds are taken every 1-10 milliseconds. Accordingly, a sample of audio data may include data corresponding to the original, emitted sound as well as the reverberated sound. For example, a spoken word may be captured by the microphone from the speaker. Additional reflections of the spoken word from surfaces within the acoustic environment of the speaker may also be captured by the microphone. The reflections will generally be delayed with respect to the spoken word. As such, a second word may be spoken which may be captured with along with the reflection of the first spoken word.

The reverberated sounds included in the captured audio data, however, will be variations on one or more original sounds. Accordingly, by comparing audio data for a first sample taken at a first time point with audio data for a sample taken at a time point occurring after the first time point, captured audio data representing these reflections can be identified and, in some implementations, removed. The reverberation time can be used to identify which previous sample can be used for dereverberation. Dereverberation can be applied to the captured audio data to remove such reflections by looking at audio data from a sample occurring at current time less the reverberation time. Dereverberation may be desirable for applications which depend on the acoustic representations of the captured audio to make decisions. For example, automatic speech recognition systems are trained on the peaks and valleys of captured audio data to make predictions as to what word or words were spoken. Inclusion of reverberation can undesirably alter the audio data as the audio data may include not only the desired spoken word, but additional data representing the reflections.

One problem with existing dereverberation processes is the ability to perform dereverberation in an efficient manner. Efficiency for automatic speech recognition can be gauged based on one of more of the processing power needed for dereverberation, the time needed for dereverberation, the memory needed to dereverberation, and the power consumed for dereverberation. The processing power may be limited in some speech recognition applications. For example, on a mobile device such as a smartphone, it may not be feasible to include a powerful multicore processor to perform dereverberation for real-time speech recognition. In some instances, dereverberation may include performing complex mathematical computations, which may require many computing cycles to complete. In aggregate, these increased cycles can impact the overall operation of the speech recognition such that noticeable delays are common. For many applications, such a delay is undesirable.

Similarly, it may not be feasible to include large memory resources to buffer data during dereverberation. Some dereverberation techniques include buffering previous dereverberation data and continually refining the past values as additional audio data is received and processed. In addition to increasing the memory usage, such techniques also require substantial memory resources to store the data. Such increased storage needs dictate a larger form factor to provide the additional storage in addition to increased power consumption for the device. These increases may be undesirable such as in mobile or small form factor implementations, such as a set-top-box or streaming media player.

In view of the constraints and limitations of dereverberation techniques discussed above, improved devices and methods for dereverberation are desirable. Although the examples and implementations described herein focus, for the purpose of illustration, on using dereverberation of audio data in an automatic speech recognition context, one skilled in the art will appreciate that the techniques described herein may be applied to other processes, methods, or systems. For example, the techniques may be used with other types of systems which process audio data for purposes other than automatic speech recognition or natural language understanding. Various aspects of the disclosure will now be described with regard to certain examples and embodiments, which are intended to illustrate but not limit the disclosure.

FIG. 1 shows a system diagram for an example audio processing system including reverberation removal. The system 100 shown in FIG. 1 includes two microphones, microphone 102 and microphone 104. The microphones may be configured to capture sound and provide audio data. The microphones may be single channel or multiple channel capture devices. In multichannel configurations, each channel may be provided as part of the audio data. As shown in FIG. 1, the microphone 102 can transmit captured audio data to a speech processing system 140. While the microphones (102 and 104) are shown as independent devices, it will be understood that one or both microphone 102 and 104 may be included in other devices such as smartphones, set-top-boxes, televisions, table computers, sound recorders, two-way radios, or other electronic device configured to capture sound and transmit audio data.

Although the examples and implementations described herein focus, for the purpose of illustration, on using dereverberation of audio data in a speech processing and automatic speech recognition contexts, one skilled in the art will appreciate that the techniques described herein may be applied to other processes, methods, or systems. For example, the techniques may be used with other types of systems which process audio data for purposes other than automatic speech recognition or natural language understanding. Various aspects of the disclosure will now be described with regard to certain examples and embodiments, which are intended to illustrate but not limit the disclosure.

The speech processing system 140 includes an automatic speech recognition ("ASR") module 142. The ASR module 142 is configured to perform automatic speech recognition on the sound captured by a microphone as audio data to predict the content of the audio data (e.g., utterances). The ASR module 142 may provide an ASR output such as a transcription of the audio data for further processing by the speech processing system 140 or another voice activated system. As noted above, the audio data may include reverberation, which can hinder the accuracy of the ASR module 142 predictions.

As shown in FIG. 1, the microphone 102 and the microphone 104 provide audio data to the speech processing system 140. The audio data may be provided directly from the microphone to the speech processing system 140. In some implementations, the audio data may be transmitted via wired, wireless, or hybrid wired and wireless means to the speech processing system 140. In some implementations, the audio data is transmitted via network (not shown) such as a cellular or satellite network. For the purpose of clarity, such intermediate devices and communication channels are omitted from FIG. 1.

FIG. 1 also illustrates the microphone 102 and the microphone 104 providing audio data to a source aggregator 106. A source aggregator 106 may be configured to receive audio data from multiple sources and provide a single audio data output. The single audio data output may include a composite audio signal generated by the source aggregator 106 from the received audio data. In some implementations, the single audio data output may include multiple channels of audio data, each channel corresponding to a source (e.g., microphone). In some implementations, the source aggregator 106 may be referred to as a receiver or a mixer.

Audio data may be provided to the source aggregator 106 as an alternative to providing audio data directly to the speech processing system 140. Conversely, the source aggregator 106 may be omitted. In such implementations, the audio data generated by the microphones of the system 100 may be provided directly to the speech processing system 140. In some implementations, selected source devices may be configured to provide audio data to the source aggregator 106 while other source devices may be configured to provide audio data directly to the speech processing system 140. For example, consider a meeting room which includes several microphones to capture sound from the crowd and a single microphone at a lectern. In such implementations, the audio data generated by the crowd microphones may be aggregated while the audio data generated by the lectern microphone may be isolated.

In view of the many possible configurations of source devices, aggregators, and speech processing systems, a dereverberator may be included in the system 100 to reduce reverberation in the audio data. As shown in FIG. 1, the microphone 104, the source aggregator 106 and the speech processing system 140 include dereverberators (200*a*, 200*b*, 200*c*, respectively). It will be appreciated that in some systems, not all these elements may include a dereverberator. For example, the microphone 102 of FIG. 1 does not include a dereverberator. In other embodiments, only one or two of the microphone 104, source aggregator 106, or speech processing system 140 include a dereverberator.

The dereverberators included in elements configured to receive audio data from multiple source devices (e.g., the dereverberator 200*b* included in the source aggregator 106 and the dereverberator 200*c* included in the speech processing system 140) may be in data communication with source descriptor storage devices (290*a* and 290*b*). The source descriptor storage devices are configured to store configuration information for source devices providing audio data. The configuration information is used by the dereverberator to remove reverberations. Because each source device may have different acoustic characteristics as well as varying acoustic environments, the parameters utilized during the reverberation process may be dynamically determined based on the source device. As discussed above, reverberation generally includes a delay between the original sound and the reflected sound. This delay can differ between source devices. As such, the audio data transmitted from a source device may also include a source device identifier. The source device identifier may be used by the dereverberator (e.g., 200*b* or 200*c*) to obtain device specific dereverberation characteristics from the associated source descriptor storage device (e.g., 290*a* or 290*b*). The source descriptor storage device 290*b* is shown within the speech processing system 140. In some implementations, this storage device 290*b* may be separated from the speech processing system 140 but configured for data communication therewith.

Whether the dereverberation occurs at the microphone 104, the source aggregator 106, or the speech processing system 140, the ASR module 142 receives the dereverberated audio data. In the discussion that follows, the dereverberator and the process by which dereverberation is achieved will be described.

Figure 2:
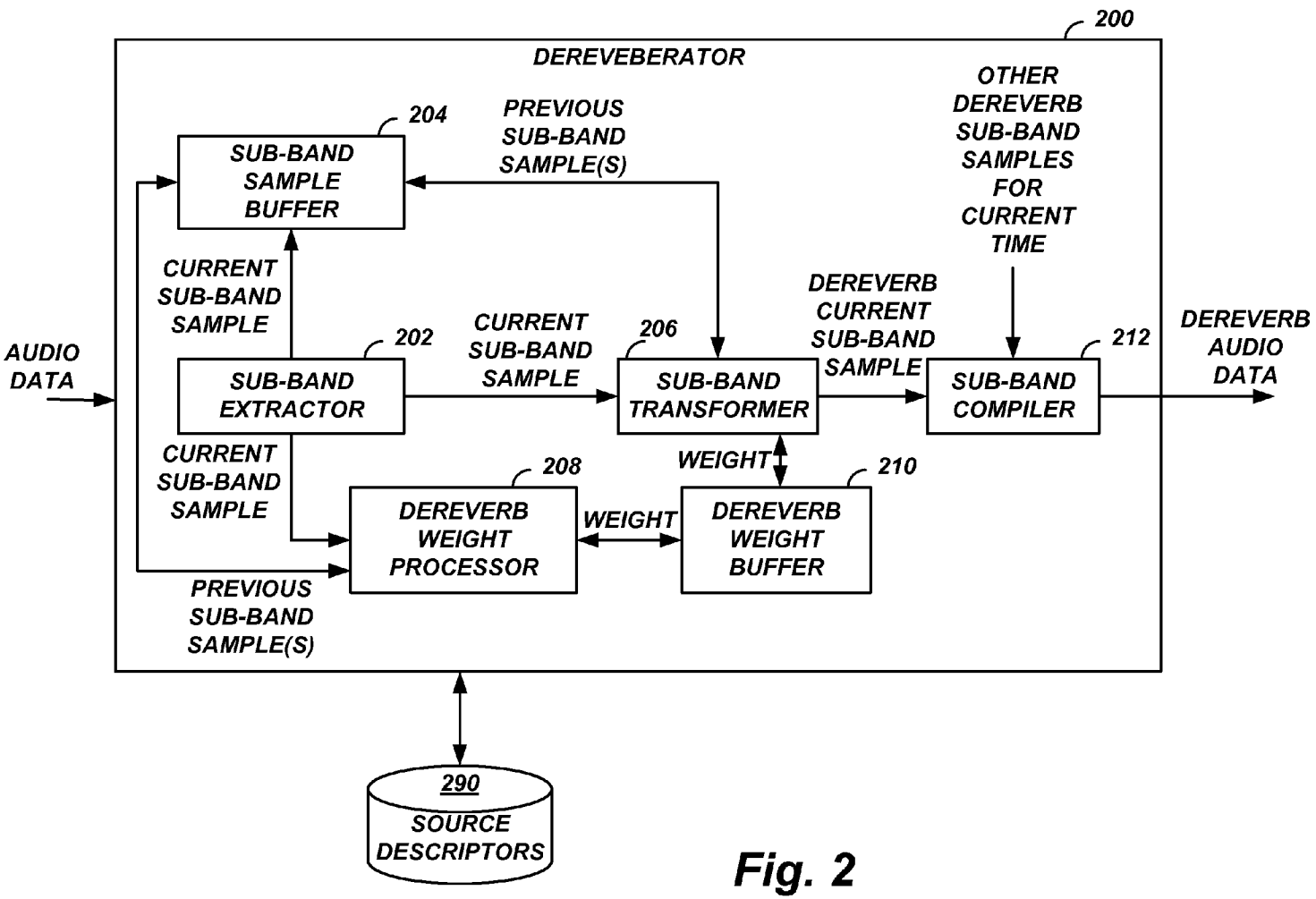
FIG. 2 shows a functional block diagram of an example dereverberator.

FIG. 2 shows a functional block diagram of an example dereverberator. The dereverberator 200 is configured to remove reverberations from received audio data. As discussed above, the audio data may be for a single channel or for multiple channels. The dereverberator 200 in FIG. 2 illustrates an implementation on single channel audio data.

A single channel of audio data may be separated into samples. A sample may refer to a portion of the audio data (e.g., 1-10 milliseconds). Within a given sample, the corresponding portion of the signal or audio data may include, or be represented by, signal components of different frequencies. The data or signal components corresponding to different frequencies may be determined from the sample. For example, the audio data may be decomposed into different frequencies. One way the decomposition may be performed is through time-frequency mapping such as via one or more fast Fourier transforms or a bank of filters which process the audio data such that the outputted audio data includes only a portion of the frequencies included in the audio data provided for decomposition. The frequencies may be grouped into bands. Each band of a sample may be referred to as a sub-band. Processing audio data at a sub-band level focuses the processing on a subset of frequencies for the audio data. By isolating certain frequencies, the dereverberation detection and removal can be further refined for each sub-band. The refinements, such as the delay, the threshold for detection, and a quantity of removal, may be determined, at least in part, by the acoustic environment where the sound was captured. For example, some rooms may dampen low frequencies due to carpeting or the shape of the room. As such, reverberation for sound in this room will not be uniform for all frequencies of the sound. As another example, a microphone or other capture device may be more sensitive to high frequencies than lower frequencies. As such, reverberation for the captured sound may not be uniform for all frequencies. The non-uniformity may be addressed by processing sub-bands of the audio data with consideration of the differences between the sub-band. For example, one sub-band may have a different volume, clarity, sample rate, or the like than another sub-band. These can impact the reverberation time and thus the quality and quantity of reverberation detection and removal. Accordingly, the reverberation detection and removal for a first sub-band data may be different than the reverberation detection and removal by accounting for the different reflection times for each. After removing the reverberation from each sub-band, the sub-bands for a given sample may be combined to reconstruct a dereverberated audio signal.

Another non-limiting advantage of sub-band reverberation processing is the sub-bands of interest may vary because of the sound or intended use of the audio data. For example, spoken word sounds may have sub-bands which are commonly represented in audio data and others which are not commonly used for spoken word sounds. For speech recognition, the commonly used sub-bands may be reverberation processed and the remaining sub-bands skipped. This can save resources such as time, power, and processing cycles, to perform dereverberation.

The dereverberator 200 is configured to remove reverberations at the sub-band level. One implementation for sub-band dereverberation includes buffering an entire utterance of audio data to be processed. In such implementations, all of the samples of a given utterance are present before any samples are processed with dereverberation. This will potentially introduce a latency of several seconds, which can be unacceptable for interactive response applications. Removing reverberations can involve determining coefficients (dereverberation coefficients) of a dereverberation filter. Such implementations may include determining the dereverberation coefficients using matrix inversions. Matrix inverse operations, however, are often numerically unstable. A matrix inverse is also computationally costly to compute. For example, inverting a P×P matrix requires a number of floating point operations which grows at an exponential rate based on $P^3$.

The dereverberator 200 of FIG. 2 provides an alternative approach to performing a computationally costly matrix inversion operation. The dereverberator 200 shown in FIG. 2 is configured to buffer a dereverberation weight 210 from a previous sub-band sample and apply this weight for the removal of reverberation in a subsequent sample from the same sub-band. In such implementations, the weight buffer need only maintain a single collection of dereverberation weights, which can be used to process the audio data as it is received rather than wait for all samples to be received.

A sub-band extractor 202 is included in the dereverberator 200. The sub-band extractor 202 is configured to parse the incoming audio data into a plurality of sub-bands. A sample extractor (not shown) may be included to divide the audio data into samples, each of which is provided to the sub-band extractor 202. The dividing may include decomposing the input audio signal via a time-frequency mapping to isolate portions of the input audio signal having frequencies included in the first frequency band. The number of sub-bands extracted may be statically configured. In some implementations, sub-band extraction may be dynamically determined by the sub-band extractor 202. As the number of sub-bands increases, the quantity of resources to remove reverberation may increase. For example, it may be desirable to adjust the number of sub-bands being processed by assessing the resources (e.g., power, memory, processing, time) available to the device including the dereverberator 200 and select a number of sub-bands for processing that utilize the all or a portion of the available resources. Accordingly, the sub-band extractor 202 may determine the number of sub-bands based on one or more of the available resource levels for the device including the dereverberator 200. The selection of the number of sub-bands may include evaluation of a relationship between values for the resources as expressed, for example, in an equation or a look up table.

The sub-band extractor 202 may be configured to provide the current sub-band sample (e.g., the sub-band sample to be dereverberated corresponding to a given point in time) to a sub-band sample buffer 204. The sub-band sample buffer 204 is configured to store sub-band samples for further processing. For example, dereverberation includes comparing a current sample to one or more previous samples to identify and reduce reflected sound captured in the audio data. The sub-band sample buffer 204 is configured to store a number of samples associated with a maximum delay period. For example, if the maximum delay for a given source device is 30 milliseconds, and if each sample is 10 milliseconds, then for a given sub-band, only 3 previous sub-band samples are buffered for dereverberation. The maximum delay for a source device may be obtained from the source descriptors data storage 290.

The sub-band extractor 202 may also be configured to provide the current sub-band sample to a sub-band transformer 206. The sub-band transformer 206 is configured to apply a transformation to the current sub-band sample to reduce its reverberation. As part of the dereverberation process, the sub-band transformer 206 obtains previous sub-band samples from the same frequency sub-band as the current sub-band. In one embodiment, the previous sub-band samples are the unprocessed sub-band samples (e.g., before applying the dereverberation). By comparing the previous sub-band sample to the current sub-band sample, differences between the two may be identified which indicate reflected sound a rather than new sound. The comparison is described in further detail below. The previous sub-band samples may be stored in the sub-band sample buffer 204. The sub-band transformer 206 may also include dereverberation weights when identifying differences between the previous and current sub-band samples.

Consider Equation (1), which is an example expression of dereverberation where Y(K) denotes the sub-band output of the single sensor at time K and Y(K) denotes a vector of M present and past sub-band outputs.

$$Y(K) \triangleq [Y(K)Y(K-1) \ldots Y(K-M+1)]^T \quad \text{Eq. (1)}$$

Dereverberation may be based on weighted prediction error. The weighted prediction error assigns different weights to predicted outcomes. In dereverberation, the weighted prediction error is included to remove the late reflections from Y(K), which implies removing that part of Y(K) which can be predicted from Y(K−Δ) for some time delay A. In such implementations, the dereverberated sub-band sample for sample K can be expressed as $$X(K) \triangleq Y(K) - w^H Y(K-\Delta) \quad \text{Eq. (2)}$$

where w denotes a vector of dereverberation weights.

The dereverberation weights of Equation (2) can be used to generate the weighted prediction error. The weighted prediction error is further based on the spectral weighting of the sub-band samples. Optimal dereverberation weights and spectral weights may be obtained by iterative processing or by taking an average of all samples. In the iterative implementation, several passes over the same data must occur. This can introduce latency and increase the resource utilization to perform dereverberation. In an averaging implementation, all samples must be obtained and processed which can also introduce latency and increase the resources needed to perform dereverberation.

Consider instead an implementation, such as that shown in FIG. 2, where a sample dependent vector of dereverberation weights is maintained in a dereverberation weight buffer 210. The initial weight vector may be obtained by the dereverberation weight processor 208 from a source descriptors data storage 290. As the weights may be device specific, the initial weight vector may be obtained by assessing the source device. For example, the audio data may include a source device identifier which can be used to retrieve or determine initial weights for the source device from the source descriptors data storage 290.

The dereverberation weight processor may store the dereverberation weight associated with an initial sub-band sample in the dereverberation weight buffer 210. The sub-band transformer 206 can then obtain the weight from the dereverberation weight buffer 210 to perform a dereverberation transform on the current sub-band sample. The dereverberation transform compares the current sub-band sample with one or more previous sub-band samples. As discussed, the previous sub-band samples may be obtained from the sub-band sample buffer 204.

For subsequent sub-band samples, the dereverberation weight processor 208 may be configured to identify a one-time spectral weighting estimate using a weight stored in the dereverberation buffer 210, the current sub-band sample, and previous sub-band samples from the sub-band sample buffer 204. One expression of the estimate is shown in Equation (3) below where (K) is the spectral weighting estimate for sample K and w is the weight vector stored in the dereverberation buffer 210 for the sub-band, and Y(K−Δ) are the previous sub-band samples from some prior time identified by the delay A. As noted above the delay may also be source device specific and may be obtained from the source descriptors data storage 290.

$$\hat{\theta}(K) = |Y(K) - w^H(K-1)Y(K-\Delta)|^2 \quad \text{Eq. (3)}$$

Once the dereverberation weight processor 208 generates the spectral weighting estimate, the dereverberation weights stored in the dereverberation weight buffer 210 are updated. The update uses an exponentially weighted covariance matrix and cross-correlation vector for the current sub-band sample. One non-limiting advantage of the weight update implemented in the dereverberator 200 is that a given sub-band sample is processed only once; therefore, only a fixed number of past sub-band samples are buffered instead of an entire utterance. A second non-limiting advantage is that the dereverberation weight vector is updated once for each sample, and therefore is immediately available to the sub-band transformer 206 for dereverberating the current sub-band sample. The dereverberation weights from the prior time or time range can thus be used for dereverberation. One expression of this dereverberation process is shown in Equation (4) below.

$$X(K) = Y(K) - w^H(K-1)Y(K-\Delta) \quad \text{Eq. (4)}$$

Once the sub-band transformer 206 removes the reverberation from the current sub-band sample, the dereverberated current sub-band sample is provided to a sub-band compiler 212. The sub-band compiler 212 may also receive other dereverberated sub-band samples for the current time (e.g., dereverberated sub-band samples from the same capture time range as the current sub-band sample). The sub-band compiler 212 combines the individual sub-bands to generate a dereverberated audio data output. The dereverberated audio data output includes the individually dereverberated sub-bands, which collectively represent a new version of the original audio data with reduced reverberation.

Figure 3:
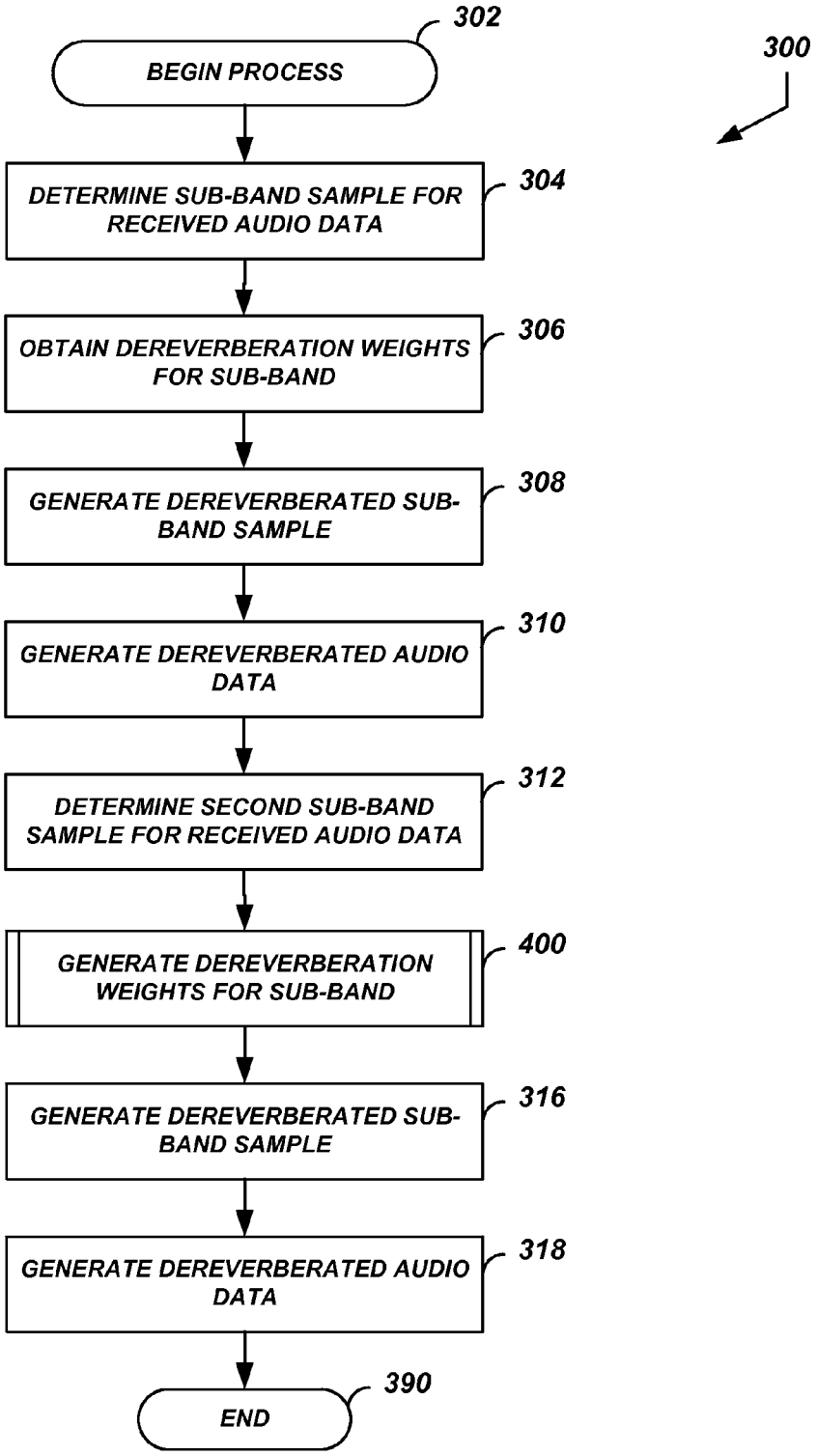
FIG. 3 shows a process flow diagram of a method for removing reverberation.

FIG. 3 shows a process flow diagram of a method for removing reverberation from audio data. The method 300 shown in FIG. 3 may be implemented in whole or in part by the dereverberator 200 shown in FIG. 2. The process begins at block 302 with the receipt of audio data for dereverberation processing. The audio data may be represented as an audio signal. At block 304, a sub-band sample is identified from received audio data. As discussed above, the identification may include splitting the audio data into samples and then further decomposing each sample into sub-bands each sub-band corresponding to a frequency range. The sub-band may further be associated with a capture time range indicating when the sub-band audio data was generated or the sound was capture that forms the basis for the sub-band audio data.

At block 306, dereverberation weights are obtained for the sub-band frequency of the identified sub-band from block 304. The dereverberation weights may be expressed as a vector of weights. In some implementations, the weights may be source device specific. As such, the weights may be generated or obtained via a source device identifier received along with or as a part of the audio data.

At block 308, a dereverberated version of the sub-band sample is generated. The dereverberated version is generated using the dereverberation weights obtained at block 306, the sub-band sample identified at block 304, and a set of previous sub-band samples from the same frequency band as the identified sub-band sample from block 304. Equation (4) above illustrates one embodiment of the dereverberation that may be performed at block 308. The dereverberation for the sub-band sample is determined using the dereverberation weights for the sub-band sample. This allows each sub-band to be weighted and dereverberated independently. For example, in such embodiments, each sample from a sub-band frequency may be weighted and/or dereverberated without referring to or otherwise using information relating to any other sub-band frequency.

In some implementations, the generation at block 308 may be use sub-band samples for other frequency bands. For example, a frequency band typically refers to a range of frequencies. A frequency value greater than the top of the range or less than the lower range value may be included neighboring frequency bands. A given frequency band includes a frequency which is the highest frequency in the band and a frequency which is the lowest frequency in the band. The given frequency band may have a low-end neighbor and a high-end neighbor. The low-end neighbor would include frequencies lower than the lowest frequency in the given band. The distance between the low-end neighbor and the given band may be defined as a lower-limit threshold. On the high-end, the high-end neighbor includes frequencies higher than the highest frequency in the given band. The distance for the high-end neighbor may also be determined by a threshold such as an upper-limit threshold. By including the previous samples from other sub-bands to form the prediction of a target sub-band, dereverberation performance can be increased. Inclusion of neighboring sub-bands can increase the computational cost for dereverberation than considering a single sub-band, however, the dereverberated result may provide audio data that is more easily recognized during processing. For example, an automatic speech recognition system may more accurately predict the audio data dereverberated using samples from the same and neighboring sub-bands. This can provide an overall efficiency gain for the system.

At block 310, dereverberated audio data is generated by combining the dereverberated version of the sub-band sample from block 308 with any other sub-band samples from the same sample time period. The audio data may be transmitted for speech recognition or other processing. In some implementations, it may be desirable to concatenate several dereverberated audio data from a series of samples into a single result for processing. One way to concatenate the sub-band samples is to reverse the filtering or transformations applied to extract the sub-bands. For example, the reconstruction may include inverting the time-frequency mapping to combine the first dereverberated sub-band sample with sub-band samples included in the audio data for different sub-bands for the first capture time range.

At block 312, a second sub-band sample is identified from the received audio data. The second sub-band sample is identified for a time period after the sub-band sample identified at block 304. The second sub-band sample is within the same frequency band as the sub-band sample identified at block 304.

At block 400, dereverberation weights are determined. The determination at block 400 considers the previous weight vector rather than requiring receipt of an entire utterance of data to perform the dereverberation. One embodiment of a process of determining dereverberation weights of block 400 is described in further detail with reference to FIG. 4 below.

At block 316, a dereverberated version of the second sub-band sample is generated based in part on the updated weights from block 400. Block 316 may also generate the dereverberated version of the second sub-band sample using the second sub-band sample and one or more sub-band samples from a time preceding the second sub-band sample. The second dereverberated sub-band sample corresponds to the first frequency band and the second time, and the second plurality of previous sub-band samples correspond to the first frequency band. Equation (4) above illustrates one embodiment of the dereverberation that may be performed at block 316.

In some implementations, the generation at block 316 may use sub-band samples for other frequency bands. For example, a frequency band typically refers to a range of frequencies. As discussed above with reference to block 308, inclusion of neighboring sub-bands can increase the computational cost for dereverberation than considering a single sub-band, however, the dereverberated result may provide audio data that is more easily recognized during processing. For example, an automatic speech recognition system may more accurately predict the audio data dereverberated using samples from the same and neighboring sub-bands. This can provide an overall efficiency gain for the system.

At block 318, the dereverberated version from block 316 is included to generate dereverberated audio data. The process 300 shown ends at block 390. It will be understood that additional audio data may be received and, in such instances, the process 300 returns to block 312 to perform additional dereverberation as described above for the next sample. During this subsequent iteration, the weights updated using the second sub-band sample will again be updated, this time using the subsequent sub-band sample.

Figure 4:
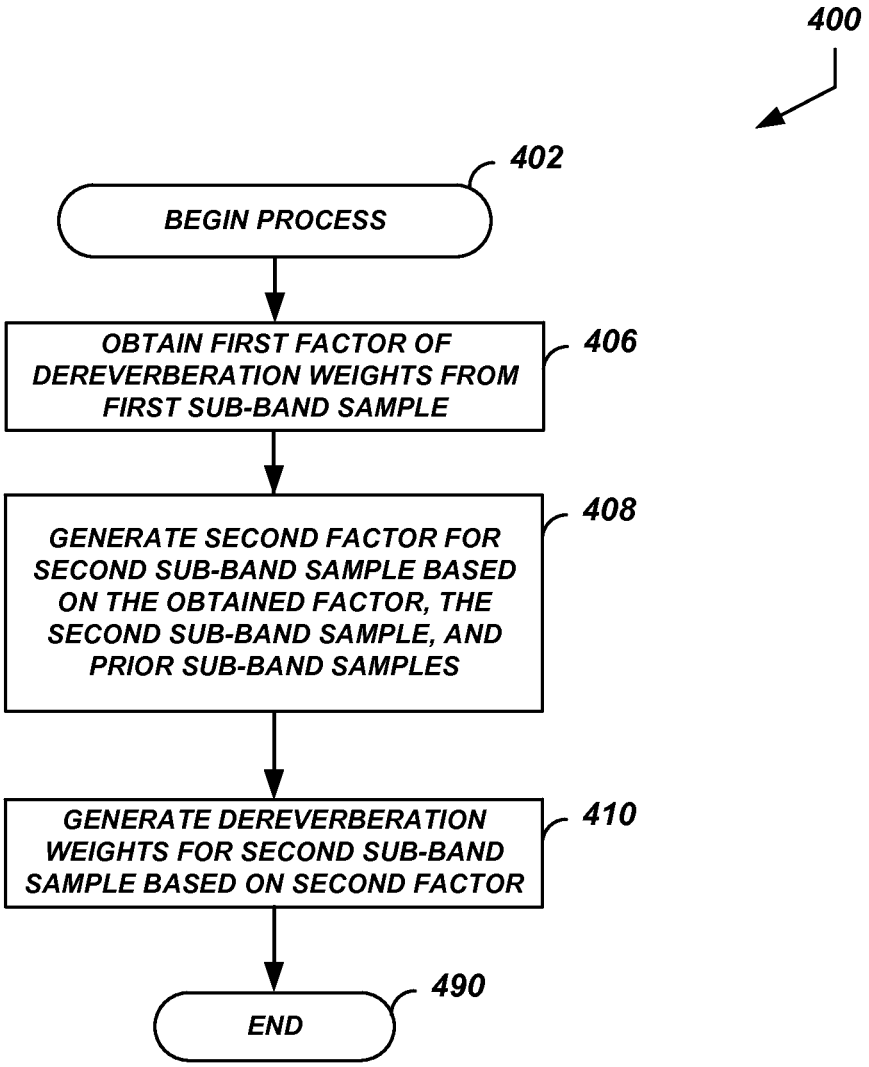
FIG. 4 shows a process flow diagram of a method for determining dereverberation weights.

FIG. 4 shows a process flow diagram of an example method for determining dereverberation weights. The process 400 shown in FIG. 4 may be implemented in whole or in part by the dereverberator 200 shown in FIG. 2. The process begins at block 402. At block 406, a first matrix factor is obtained. The first matrix factor corresponds to the dereverberation weights from the previous sub-band sample (e.g., K−1). In some implementations, the matrix factor may be a Cholesky factor. The initial Cholesky factor may be obtained by decomposing an omission matrix (e.g., matrix including regular pattern of zeroes) into two or more smaller and regular matrices. Solving for these decomposed matrices can be more efficient than solving the non-decomposed matrix. As the matrix may include a significant pattern of zeroes, the solution may be reduced to solving for one element of a matrix. This one element of a matrix which can drive the solution of the non-decomposed through forward and backward substitutions may be referred to as the matrix factor or the Cholesky factor. The initial Cholesky factor may be obtained through correlation calculation for a sub-band sample matrix to identify the coefficients which exhibit the lowest probability of error. The calculation may include solving a linear equation through a series of matrix operations.

At block 408, a second matrix factor is generated for the second sub-band sample using the first matrix factor from block 402, the second sub-band sample, and prior sub-band samples from the same frequency band. In some implementations, the matrix factor may be a Cholesky factor as described with reference to block 406.

At block 410, updated dereverberation weights are generated from the second subsample using the second matrix factor. The first and the second matrix factors may be implemented to avoid inverse matrix operations during the updating process. One such technique is through the use of recursive least squares estimation.

One example method of recursive least squares estimation may include an exponentially-weighted sample spectral matrix. An example of an exponentially-weighted sample spectral matrix is shown in Equation (5) below.

$$\Phi(K) \triangleq \sum_{k=1}^{K} \frac{\mu^{K-k} Y(k-\Delta) Y^H(k-\Delta)}{\theta(k)} \quad \text{Eq. (5)}$$

In Equation (5), the exponentially-weighted sample spectral matrix Φ(K) includes a forgetting factor μ which is a value between 0 and 1. To implement a least square error beamformer efficiently using the exponentially-weighted sample spectral matrix, an inverse matrix for the spectral matrix at time K and K−1 must be calculated. This calculation is needed to arrive at a precision matrix for at K time. The precision matrix is included in generating a gain vector, such as a Kalman gain vector (g), for K.

In order to formulate the recursive least squares estimator, the current subband sample Y(K) may play the role of the desired response. An innovation (s) of the estimator for frame K may be defined as shown in Equation (6).

$$s(K) \triangleq Y(K) - w^H(K-1) Y(K-\Delta) \quad \text{Eq. (6)}$$

Weights may then be updated recursively. The update may be performed through an implementation of Equation (7).

$$\hat{w}^H(K) = \hat{w}^H(K-1) + g^H(K) s(K) \quad \text{Eq. (7)}$$

This implementation of a recursive least squares estimation may be suitable for general weight operations, such as offline processes which have an abundant quantity of resources available for computing the results. However, such implementations rely on inverse matrix operations in maintaining the precision matrix P(K) as the precision matrix is propagated forward in time with this covariance form of the estimator.

In another implementation of the recursive least squares estimation, the exponentially-weighted spectral matrix Φ(K) may be propagated directly. Such an estimation may be referred to as the "information form" of the RLS estimator. Having Φ(K) or its Cholesky factor directly available provides several non-limiting advantages including enabling diagonal loading to be applied in order to increase system robustness. The information RLS recursion may be expressed as two equations, Equation (8) and Equation (9). Equation (8) and (9) include spectral weights determined by Equation (3) above as a divisor.

$$w^H(K)\Phi(K) = \mu w^H(K-1)\Phi(K-1) + \frac{1}{\theta(K)} Y(K) Y^H(K-\Delta) \quad \text{Eq. (8)}$$

$$\Phi(K) = \mu\Phi(K-1) + \frac{Y(K-\Delta) Y^H(K-\Delta)}{\theta(K)} \quad \text{Eq. (9)}$$

It may be desirable to include matrix decomposition to expedite the processing for the recursion. One such decomposition is a Cholesky decomposition. Φ(K) may be expressed in factored form as $\Phi^{H/2}(K)*\Phi^{1/2}(K)$ where $\Phi^{H/2}(K)$ is the lower triangular Cholesky factor. By applying this factored form, Equations (8) and (9) may be rewritten as Equations (10) and (11), respectively.

$$\Phi^{H/2}(K)\Phi^{1/2}(K) = \mu\Phi^{H/2}(K-1)\Phi^{1/2}(K-1) + \frac{1}{\theta(K)} Y(K-\Delta) Y^H(K-\Delta) \quad \text{Eq. (10)}$$

-continued $$w^H(K)\Phi^{H/2}(K)\Phi^{1/2}(K) = \mu w^H(K-1)\Phi^{H/2}(K-1)\Phi^{1/2}(K-1) + \frac{1}{\theta(K)} Y(K) Y^H(K-\Delta) \quad \text{Eq. (11)}$$

Using Equations (10) and (11), a pre-array may be generated as an expression of the lower triangular Cholesky factor. One example of such a pre-array is shown in Equation (12).

$$A = \begin{bmatrix} \mu^{1/2}\Phi^{H/2}(K-1) & \theta^{-1/2}(K) Y(K-\Delta) \\ \mu^{1/2}\hat{w}^H(K-1)\Phi^{H/2}(K-1) & \theta^{-1/2}(K) Y(K) \end{bmatrix} \quad \text{Eq. (12)}$$

A unitary transform is desirable to transform the pre-array shown in Equation (12) to an array (B) which includes data from the current time K. One expression of such an array (B) is shown in Equation (13).

$$\begin{bmatrix} B_{11}^H(K) & 0 \\ b_{21}^H(K) & b_{22}^*(K) \end{bmatrix} \quad \text{Eq. (13)}$$

The unitary transform may be generated through a set of Givens rotations. Givens rotations are a convenient means for implementing a Cholesky or QR decomposition. They also find frequent application in other matrix decomposition and decomposition updating algorithms, inasmuch as they provide a convenient means of imposing a desired pattern of zeroes on a given matrix. For instance, they can be used to restore a pre-array (such as that shown in Equation (12)) to lower triangular form, as is required for the square-root implementation of a recursive least squares (RLS) estimator.

Givens rotations for performing the update inherent in the covariance form of the square-root implementation of the recursive least squares estimator. As described in Section 4, this requires restoring the pre-array (such as that shown in Equation (12)) to lower triangular form. This in turn entails forcing a desired pattern of zeroes on the first row and last column of the pre-array in order to obtain a post-array.

A Givens rotation may be completely specified by two indices: (1) the element which is to be annihilated; and (2) the element into which the annihilated element is to be rotated. The update involves rotating the elements in the last column into the leading diagonal, as shown in FIG. 5.

Figure 5:
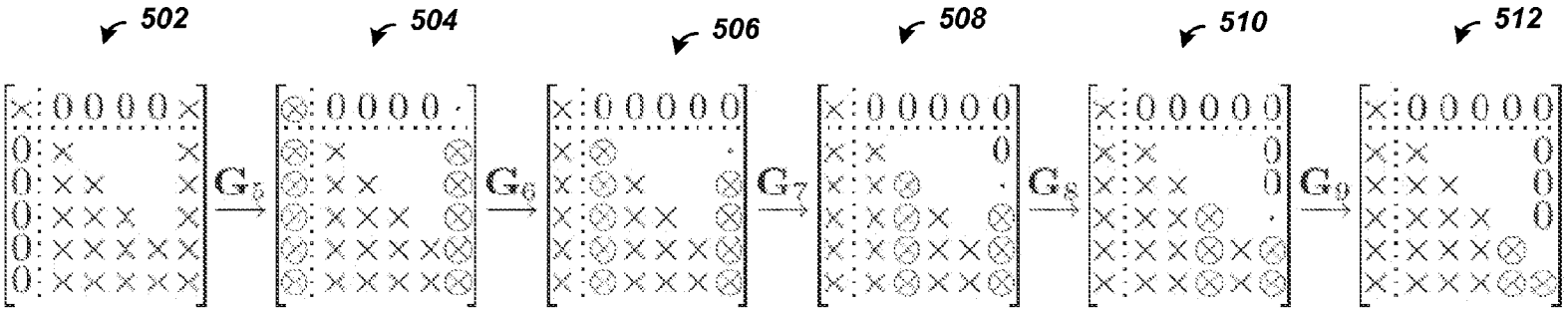
FIG. 5 is a sequence diagram illustrating an example series of Givens rotations which may be implemented in the recursive least squares estimator.

FIG. 5 is a sequence diagram illustrating an example series of Givens rotations which may be implemented in the recursive least squares estimator. In FIG. 5, the element annihilated by the last rotation is marked with a •. Non-zero elements that were altered by the last rotation are marked with ⊗. Non-zero elements that were not altered by the last rotation are marked with x. Zero elements that were annihilated in prior rotations, or that will become non-zero, are marked with 0. Other zero elements are not shown. FIG. 5 shows six matrices (502, 504, 506, 508, 510, and 512), each matrix after matrix 502 being a rotated version of the preceding matrix. For example, matrix 503 is a rotated version of matrix 502.

The Givens rotation described is one way to enforce a desired pattern of zeroes on an array. In some implementations, it may be desirable to implement a Householder transform to enforce the desired pattern of zeroes.

Using Givens rotations to extract the Cholesky factors of a matrix can provide a similar result as extracting the inverse of the matrix. Suppose, for example, we are confronted with a problem of finding that x satisfying A x=b for some known b and symmetric positive definite (N×N) matrix A. One solution may entail forming the inverse ($A^{-1}$), and then solving as $x=A^{-1}$ b. The inverse, however, can be numerically unstable and require significant quantities of resources to process. These resources may be particularly limited in an online (e.g., real-time) processing system such as mobile devices. Thus, instead of forming the inverse, another implementation may include extracting the lower triangular Cholesky factor $A^{1/2}$ by the application of a set of Givens rotations as described above. Thereafter, we can set $y=A^{T/2}x$ and arrive at the expression of b where $A^{1/2}y=b$.

The Cholesky factor of $A^{1/2}$ can be expressed as shown in Equation (14).

$$A^{1/2} = \begin{bmatrix} a_{0,0} & 0 & \dots & 0 \\ a_{1,0} & a_{1,1} & \dots & 0 \\ \vdots & \vdots & \ddots & \vdots \\ a_{N-1,0} & a_{N-1,1} & \dots & a_{N-1,N-1} \end{bmatrix} \quad \text{Eq. (14)}$$

This allows the components of y to be solved using forward substitution. It should be noted that the forward substitution does not involve inverse matrix operations. The substitution is referred to as a forward substitution because the complete solution is obtained by beginning with $y_0$ and working forward through the rest of the components. Once y is known, we can write $A^{T/2}x=y$. From this form, backward substitution may be performed to solve for the components of x, which entails first solving for the element $x_{N-1}$ where the solution may be expressed as shown in Equation (15).

$$x_{N-1}=y_{N-1}/a_{N-1,N-1} \quad \text{Eq. (15)}$$

Working backwards, the rest of the components of y can then be identified.

Returning to Equation (13), the Cholesky factor needed for the next iteration of the recursion is the first element of the first column, namely $B_{11}{}^{H}(k)$.

The Cholesky factor may be used to solve for an optimal weight through backward substitution as discussed above. The backward substitution may be performed on Equation (16).

$$\hat{w}^{H}(K)B_{11}{}^{H}(K)=b_{21}{}^{H}(K) \quad \text{Eq. (16).}$$

The square-root implementation described above is based on the Cholesky decomposition. A Cholesky decomposition can exist for symmetric positive definite matrices. One non-limiting advantage of dereverberation implementing the square-root implementation is immunity to the explosive divergence which may be present in direct (e.g., non-square-root) implementations, whereby the covariance matrices, which must be updated at each time step, become indefinite. For example, square-root implementations may effectively double the numerical precision of the direction form implementation, although they require somewhat more computation. However, the incremental increase in computation features performance improvements that outweigh the alternative implementation. For example, the accuracy and speed of dereverberation which includes square-root implementations may exceed a direction form implementation.

Additional diagonal loading may be applied to the spatial spectral covariance matrix the exponentially weighted covariance matrix ($\Phi(K)$). This extra diagonal loading limits the size of $\hat{w}(K)$ and thereby improves the robustness of the beamformer.

In some implementations, diagonal loading can be applied in the square-root implementation considered above. Whenever $\mu<1$, loading decays with time, in which case $\hat{w}(K)$ generally grows larger with increasing K. One non-limiting advantage of the information form of the RLS estimator discussed above is that it enables this diagonal loading to be easily replenished.

For example, consider an implementation where e, denotes the ith unit vector. It may be desirable to apply loading ($\beta^2(K)$) to the ith diagonal component of the exponentially-weighted sample spectral matrix. One expression of such an application is shown in Equation (17).

$$\Phi_L(K)=\Phi(K)+\beta^2(K)w_i e_i^T \quad \text{Eq. (17)}$$

A pre-array of the lower triangular Cholesky factor for Equation (17) may be expressed as shown in Equation (18).

$$A=[\Phi^{H/2}(K)\vdots\beta(K)e_i] \quad \text{Eq. (18)}$$

Similar to the pre-array discussed above with reference to Equation (12), a unitary transform may be identified to transform the pre-array, such as that shown in Equation (18). Equation (19) provides an expression of the application of a unitary transform ($\theta_i$) to the pre-array (A).

$$A\theta_i=[\Phi_L{}^{H/2}(K)\vdots 0] \quad \text{Eq. (19)}$$

The first element of the first column of the transformed matrix shown in Equation (19) is the desired Cholesky decomposition (e.g., Cholesky factor). To solve and apply each unitary transform directly, requires an exponentially squared number of operations. Accordingly, the number of operations to load all diagonal components for the spectral matrix for a point in time (K) is an exponentially cubed number of operations. However, the diagonal loading need not be maintained at an exact level, but only within a broad range. Thus, with each iteration of the recursive least squares estimation, the diagonal components of $\Phi^{1/2}(K)$ can be successively loaded. In this way, the recursive process remains an exponentially squared operation.

One non-limiting advantage of the methods shown in FIGS. 3 and 4 is that the dereverberation weights are updated once for each sub-band sample. The described features provide operational efficiency in that the weights can be accurately updated for a sub-band sample without necessarily iterating the process for a given sample or waiting for a full utterance.

Depending on the embodiment, certain acts, events, or functions of any of the processes or algorithms described herein can be performed in a different sequence, can be added, merged, or left out altogether (e.g., not all described operations or events are necessary for the practice of the algorithm). Moreover, in certain embodiments, operations, or events can be performed concurrently, e.g., through multi-threaded processing, interrupt processing, or multiple processors or processor cores or on other parallel architectures, rather than sequentially.

The various illustrative logical blocks, modules, routines, and algorithm steps described in connection with the embodiments disclosed herein can be implemented as electronic hardware, or as a combination of electronic hardware and executable software. To clearly illustrate this interchangeability, various illustrative components, blocks, modules, and steps have been described above generally in terms of their functionality. Whether such functionality is implemented as hardware, or as software that runs on hardware, depends upon the particular application and design constraints imposed on the overall system. The described functionality can be implemented in varying ways for each particular application, but such implementation decisions should not be interpreted as causing a departure from the scope of the disclosure.

Moreover, the various illustrative logical blocks and modules described in connection with the embodiments disclosed herein can be implemented or performed by a dereverberation processing device. The dereverberation processing device may include a digital signal processor (DSP), an application specific integrated circuit (ASIC), a field programmable gate array (FPGA), a microprocessor, a controller, microcontroller, or other programmable logic element, discrete gate or transistor logic, discrete hardware components, or any combination thereof. Such dereverberation processing devices are specially designed to perform the reverberation removal described herein. A dereverberation processing device may include electrical circuitry configured to process specific computer-executable dereverberation instructions to perform the reverberation removal described herein. In embodiments where the dereverberation processing device includes a FPGA or similar programmable elements, the dereverberation processing device may provide reverberation removal without processing computer-executable instructions but instead by configuring the FPGA or similar programmable element to perform the recited features. Although described herein primarily with respect to digital technology, a dereverberation processing device may also include primarily analog components. For example, some or all of the reverberation removal described herein may be implemented in analog circuitry or mixed analog and digital circuitry.

The elements of a method, process, routine, or algorithm described in connection with the embodiments disclosed herein can be embodied directly in dereverberation hardware, in a software module executed by a dereverberation processing device, or in a combination of the two. A dereverberation software module can reside in RAM memory, flash memory, ROM memory, EPROM memory, EEPROM memory, registers, hard disk, a removable disk, a CD-ROM, or similar form of a non-transitory computer-readable storage medium. An exemplary storage medium can be coupled to the dereverberation processing device such that the dereverberation processing device can read information from, and write information to, the storage medium. In the alternative, the storage medium can be integral to the dereverberation processing device. The dereverberation processing device and the storage medium can reside in an ASIC. The ASIC can reside in a device configured to capture or process audio data such as a microphone, a smartphone, a set-top-box, a tablet computer, an audio mixer, a speech processing server, or the like. In the alternative, the dereverberation processing device and the storage medium can reside as discrete components in a device configured to capture or process audio data.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

As used herein, the terms "determine" or "determining" encompass a wide variety of actions. For example, "determining" may include calculating, computing, processing, deriving, generating, obtaining, looking up (e.g., looking up in a table, a database or another data structure), ascertaining and the like via a hardware element without user intervention. Also, "determining" may include receiving (e.g., receiving information), accessing (e.g., accessing data in a memory) and the like via a hardware element without user intervention. Also, "determining" may include resolving, selecting, choosing, establishing, and the like via a hardware element without user intervention.

As used herein, the terms "provide" or "providing" encompass a wide variety of actions. For example, "providing" may include storing a value in a location of a storage device for subsequent retrieval, transmitting a value directly to the recipient via at least one wired or wireless communication medium, transmitting or storing a reference to a value, and the like. "Providing" may also include encoding, decoding, encrypting, decrypting, validating, verifying, and the like via a hardware element.

While the above detailed description has shown, described, and pointed out novel features as applied to various embodiments, it can be understood that various omissions, substitutions, and changes in the form and details of the devices or algorithms illustrated can be made without departing from the spirit of the disclosure. As can be recognized, certain embodiments described herein can be embodied within a form that does not provide all of the features and benefits set forth herein, as some features can be used or practiced separately from others. The scope of certain embodiments disclosed herein is indicated by the appended claims rather than by the foregoing description. All changes which come within the meaning and range of equivalency of the claims are to be embraced within their scope.

What is claimed is:

1. A device for reducing reverberation in an audio signal, the device comprising:

computer-readable memory storing executable instructions;

one or more physical computer processors in communication with the computer-readable memory, wherein the one or more physical computer processors are programmed by the executable instructions to at least:

receive an input audio signal;

determine a first sub-band sample from the input audio signal, wherein the first sub-band sample corresponds to a first capture time range and a first frequency band, the first capture time range identifying a first period of time during which the first sub-band sample was captured;

obtain first dereverberation weights corresponding to the first frequency band;

determine a first dereverberated sub-band sample using the first dereverberation weights, the first sub-band sample, and a first plurality of sub-band samples corresponding to a period of time of capture preceding the first capture time range, wherein the first dereverberated sub-band sample corresponds to the first frequency band and the first capture time range, and the first plurality of sub-band samples includes samples having frequencies included in the first frequency band;

generate a first dereverberated output audio sample using the first dereverberated sub-band sample;

determine a second sub-band sample from the input audio signal, wherein the second sub-band sample corresponds to a second capture time range and the first frequency band, the second capture time range identifying a second period of time of capture occurring after the first capture time range;

obtain a first Cholesky factor of a first matrix corresponding to the first dereverberation weights;

generate a second Cholesky factor of a second matrix using the second sub-band sample, the first Cholesky factor, and a second plurality of sub-band samples corresponding to a third period of time of capture preceding the second capture time range and including samples having frequencies included in the first frequency band;

generate second dereverberation weights using the second Cholesky factor;

generate a second dereverberated sub-band sample using the second dereverberation weights, the second sub-band sample, and the second plurality of sub-band samples, wherein the second dereverberated sub-band sample corresponds to the first frequency band and the second capture time range; and generate a second dereverberated output audio sample using the second dereverberated sub-band sample.

2. The device of claim 1, wherein the instructions further comprise instructions to calculate the second dereverberated sub-band sample according to a mathematical relationship:

$$X(K)=Y(K)-w^H(K-1)Y(K-\Delta)$$

where X(K) is the second dereverberated sub-band sample, Y(K) is the second sub-band sample, Y(K−Δ) is the second plurality of sub-band samples, and $w^H(K-1)$ is the second dereverberation weights.

3. The device of claim 1, wherein the instructions further comprise instructions to generate the first sub-band sample from the input audio signal by decomposing the input audio signal via a time-frequency mapping to isolate portions of the input audio signal having frequencies included in the first frequency band.

4. The device of claim 3, wherein the instructions further comprise instructions to generate the first dereverberated output audio sample by inverting the time-frequency mapping to combine the first dereverberated sub-band sample with sub-band samples included in the audio data for different sub-bands within the first capture time range.

5. A device for reducing reverberation in an audio signal, the device comprising:

computer-readable memory storing executable instructions;

one or more physical computer processors in communication with the computer-readable memory, wherein the one or more physical computer processors are programmed by the executable instructions to at least:

receive an input audio signal;

determine a first sub-band sample from the input audio signal, wherein the first sub-band sample corresponds to a first frequency band and a first capture time range identifying a first period of time during which the first sub-band sample was captured;

determine a first matrix decomposition factor of a first matrix corresponding to first dereverberation weights generated prior to determining the first sub-band sample;

determine a second matrix decomposition factor of a second matrix using the first sub-band sample and the first matrix decomposition factor;

determine second dereverberation weights using the second matrix decomposition factor;

determine a first dereverberated sub-band sample using the second dereverberation weights, the first sub-band sample, and a plurality of sub-band samples including samples having frequencies included in the first frequency band, the plurality of sub-band samples corresponding to a second period of time of capture preceding the first capture time range, wherein the first dereverberated sub-band sample corresponds to the first frequency band and the first capture time range; and determine a dereverberated output audio sample using the first dereverberated sub-band sample.

6. The device of claim 5, wherein the one or more physical computer processors are programmed by the executable instructions to generate a spectral weight using the received input audio data for a plurality of frequency bands including the first frequency band, the first dereverberation weights, and a delay factor, and wherein the second dereverberation weights are further determined using the spectral weight.

7. The device of claim 6, wherein generating the spectral weight includes calculating the spectral weight according to a mathematical relationship:

$$|Y(K)-w^H(K-1)Y(K-\Delta)|^2$$

where Y(K) is the first sub-band sample, Y(K−Δ) is the plurality of sub-band samples, and $w^H(K-1)$ is the first dereverberation weights.

8. The device of claim 6, wherein determining the second dereverberation weights using the spectral weight comprises generating an information form of a recursive least squares estimator, wherein the recursive least squares estimator generates the second dereverberation weights using an exponentially weighted sample spectral matrix and an exponentially weighted covariance vector which each include the spectral weight as a divisor.

9. The device of claim 5, wherein determining the first dereverberated sub-band sample includes computing the first dereverberated sub-band sample according to a mathematical relationship:

$$X(K)=Y(K)-w^H(K-1)Y(K-\Delta),$$

where X(K) is the first dereverberated sub-band sample, Y(K) is the first sub-band sample, Y(K−Δ) is the plurality sub-band samples, and $w^H(K-1)$ is the second dereverberation weights.

10. The device of claim 5, wherein each sub-band of the input audio data is processed separately such that determining a derverberated sub-band sample for samples having frequencies included in a given frequency band includes only consideration of dereverberation weights for the given frequency band.

11. The device of claim 5, wherein the first sub-band sample comprises 1 to 10 milliseconds of the input audio signal.

12. The device of claim 5, wherein the plurality of sub-band samples further includes samples from a second frequency band, the samples of the second frequency band having:

frequencies higher than the highest frequency included first frequency band by a predetermined upper-limit; or frequencies lower than the lowest frequency included in first frequency band by a predetermined lower-limit.

13. The device of claim 5, wherein the first matrix decomposition factor and the second matrix decomposition factor are Cholesky factors.

14. The device of claim 5, wherein determining the first sub-band sample from the input audio signal comprises decomposing the input audio signal via a time-frequency mapping to isolate portions of the input audio signal having frequencies to be included in the first frequency band.

15. The device of claim 14, wherein determining the first dereverberated output audio sample includes inverting the time-frequency mapping to combine the first dereverberated sub-band sample is with sub-band samples included in the audio data for different sub-bands for the first capture time range.

16. A non-transitory computer readable medium storing a computer-executable module that, when executed by a processor of an audio processing device, causes the audio processing device to process audio data by:

receiving an input audio signal;

determining a first sub-band sample from the input audio signal, wherein the first sub-band sample corresponds to a first frequency band and a first capture time range identifying a first period of time during which the first sub-band sample was captured;

obtaining a first matrix decomposition factor of a first matrix corresponding to first dereverberation weights generated prior to determining the first sub-band sample;

determining a second matrix decomposition factor of a second matrix using the first sub-band sample and the first matrix decomposition factor;

generating second dereverberation weights using the second matrix decomposition factor;

determining a first dereverberated sub-band sample using the second dereverberation weights, the first sub-band sample, and a plurality of sub-band samples including samples having frequencies included in the first frequency band, the plurality of sub-band samples corresponding to a second period of time of capture preceding the first capture time range, wherein the first dereverberated sub-band sample corresponds to the first frequency band and the first capture time range; and determining a dereverberated output audio sample using the first dereverberated sub-band sample.

17. The non-transitory computer readable medium of claim 16, wherein the computer-executable module that, when executed by the processor of the audio processing device, further causes the audio processing device to generate a spectral using the received input audio data for a plurality of frequency bands including the first frequency band, the first dereverberation weights, and a delay factor, and wherein the second dereverberation weights are further determined using the spectral weight.

18. The non-transitory computer readable medium of claim 17, generating the spectral weight includes computing the spectral weight according to a mathematical relationship:

$$|Y(K)-w^H(K-1)Y(K-\Delta)|^2$$

where Y(K) is the first sub-band sample, Y(K−Δ) is the plurality of sub-band samples, and $w^H(K-1)$ is the first dereverberation weights.

19. The non-transitory computer readable medium of claim 17, wherein generating the second dereverberation weights using the spectral weight comprises generating an information form of a recursive least squares estimator, wherein the recursive least squares estimator generates the second dereverberation weights using an exponentially weighted sample spectral matrix and an exponentially weighted covariance vector which each include the spectral weight as a divisor.

20. The non-transitory computer readable medium of claim 16, wherein determining the first dereverberated sub-band sample includes computing the first dereverberated sub-band sample according to a mathematical relationship:

$$X(K)=Y(K)-w^H(K-1)Y(K-\Delta),$$

where X(K) is the first dereverberated sub-band sample, Y(K) is the first sub-band sample, Y(K−Δ) is the of previous sub-band samples, and $w^H(K-1)$ is the second dereverberation weights.

21. The non-transitory computer readable medium of claim 18, wherein the first matrix decomposition factor and the second matrix decomposition factor are Cholesky factors.

* * * * *